US007850539B2

(12) United States Patent
Quinn

(10) Patent No.: US 7,850,539 B2
(45) Date of Patent: Dec. 14, 2010

(54) GRIP HOOK GOLF BALL RETRIEVER

(76) Inventor: Thomas Edward Quinn, 5143 Inadale Ave., Los Angeles, CA (US) 90043

( * ) Notice: Subject to any disclaimer, the term of this patent is extended or adjusted under 35 U.S.C. 154(b) by 0 days.

(21) Appl. No.: 12/488,384

(22) Filed: Jun. 19, 2009

(65) Prior Publication Data

US 2009/0318241 A1 Dec. 24, 2009

Related U.S. Application Data

(60) Provisional application No. 61/074,039, filed on Jun. 19, 2008.

(51) Int. Cl.
*A63B 47/02* (2006.01)

(52) U.S. Cl. ..... 473/286; 294/19.2

(58) Field of Classification Search ..... 473/286
See application file for complete search history.

(56) References Cited

U.S. PATENT DOCUMENTS 3,922,026 A * 11/1975 Schweitzer ..... 294/19.2
5,460,366 A 10/1995 Pugh
5,520,389 A 5/1996 Furrow
5,899,511 A * 5/1999 Dinatale ..... 294/19.2
6,159,108 A * 12/2000 de la Pena ..... 473/286
6,485,075 B1 * 11/2002 McClain ..... 294/19.2
6,743,113 B2 6/2004 Pettinga et al.
6,817,955 B2 * 11/2004 O'Donnell et al. ..... 473/284
7,351,156 B1 4/2008 Panneri et al.
2002/0169030 A1 11/2002 Chun-Sheng
2003/0195054 A1 10/2003 Rioux
2005/0170904 A1 * 8/2005 Smeeth ..... 473/286
2006/0058109 A1 * 3/2006 Wilson ..... 473/286
2008/0182679 A1 7/2008 Trudeau

* cited by examiner

*Primary Examiner*—Stephen L. Blau
(74) *Attorney, Agent, or Firm*—Risso & Associates; Marcus Risso

(57) ABSTRACT

A retrieval apparatus for retrieving golf balls is disclosed. The retrieval apparatus may be attached to a golf club handle and may include a flexible collar disposed for attachment around the golf club handle. The retrieval apparatus may also include a pair of tines projecting distally from a neck portion and the collar wherein the neck portion bridges the collar to the pair of tines and, wherein the tines define a substantially circular forked carrier for holding the golf ball. The tines may also include a sloped surface on each of the tines disposed to lift the golf ball and guide the golf ball into the forked carrier.

8 Claims, 4 Drawing Sheets

GRIP HOOK GOLF BALL RETRIEVER

RELATED APPLICATIONS

This application claims the benefit of priority from and incorporates by reference, U.S. provisional patent application 61/074,039, filed Jun. 19, 2008.

BACKGROUND OF THE INVENTION

The present invention generally relates to golf club accessories, and more particularly to, a detachable golf ball retriever.

During the play or practice of golf, it is a common occurrence for a golfer to stoop over and re-tee up the next practice ball. A golfer may need to do this over and over dozens of times when practicing off the tee. Conversely, a golfer may need to pick up a golf ball off the floor dozens of times as well.

One proposed solution to retrieving a golf ball can be seen in U.S. Patent Publication No. 2008/0182679 by Trudeau. Trudeau discloses a golf ball retriever that includes an annular collar that is stored on a clip by means of a journal spike entering into a cavity in the handle of the clip. One may use the device by positioning the annular collar around the golf ball and pressing the collar down around the ball. When not in use, the device may be attached to a golf bag by use of a carabiner.

Another device, as seen in U.S. Pat. No. 7,351,156, uses a modified golf club grip that includes a ball carrier that uses a shank and a pair of carrier arms extending from the cavity of the club handle. The ball carrier appears permanently attached for each golf club incorporating the device.

As can be seen, there is a need for a golf ball retrieval apparatus that mitigates the need to stoop over. It can also be seen that an apparatus that helps correct alignment in the grip of a golf club may also be desirable.

SUMMARY OF THE INVENTION

In one aspect of the present invention, a retrieval apparatus for attachment to a golf club handle and retrieval of a golf ball, comprises a flexible collar disposed for attachment around the golf club handle; a neck portion connected to the flexible collar; a pair of tines projecting distally from the neck portion and the collar wherein the neck portion bridges the collar to the pair of tines and, wherein the tines are disposed to define a substantially circular and forked carrier between the tines; and a sloped surface on each of the tines disposed to lift the golf ball and guide the golf ball into the forked carrier.

These and other features, aspects and advantages of the present invention will become better understood with reference to the following drawings, description and claims.

DETAILED DESCRIPTION OF THE INVENTION

The following detailed description is of the best currently contemplated modes of carrying out exemplary embodiments of the invention. The description is not to be taken in a limiting sense, but is made merely for the purpose of illustrating the general principles of the invention, since the scope of the invention is best defined by the appended claims.

Various inventive features are described below that can each be used independently of one another or in combination with other features.

Broadly, embodiments of the present invention generally provide a ball retrieval apparatus that allows a user to slide the apparatus from the end of a handle under a ball to scoop the ball up and retrieve the ball without needing to stoop over and pick the ball up. Exemplary embodiments of the present invention also provide an apparatus for correcting the alignment of a golf club while the club is held in preparation in the back swing position.

Figure 1:
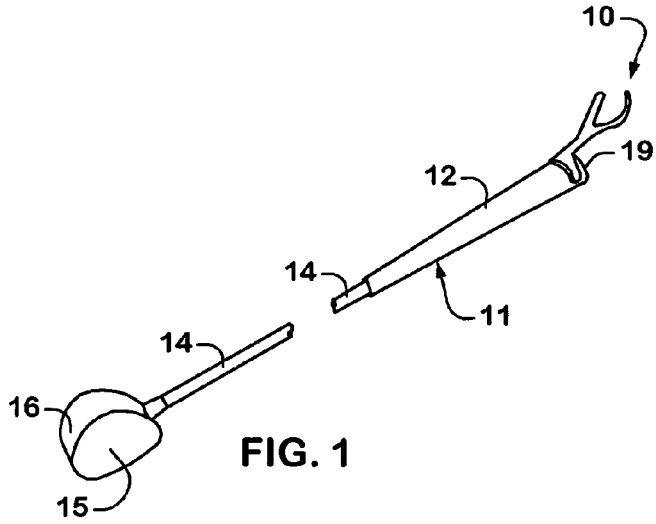
FIG. 1 is a perspective view according to an exemplary embodiment of the present invention in use on a golf club.
Figure 2:
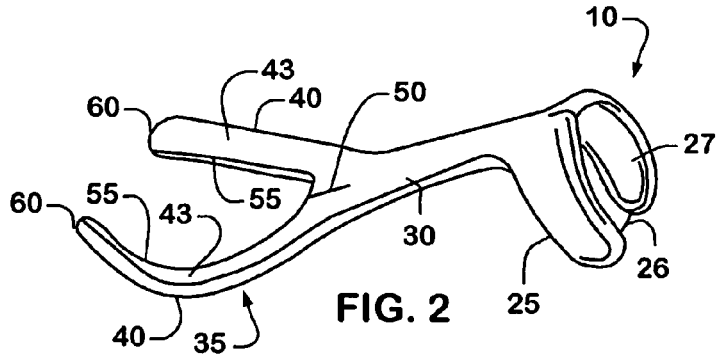
FIG. 2 is a perspective view according to an exemplary embodiment of the present invention.
Figure 3:
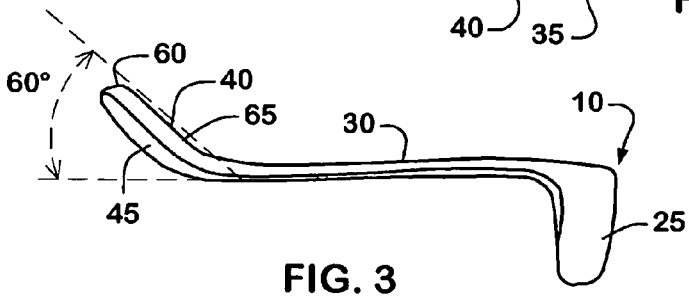
FIG. 3 is a side view of the exemplary embodiment shown in FIG. 2.
Figure 4:
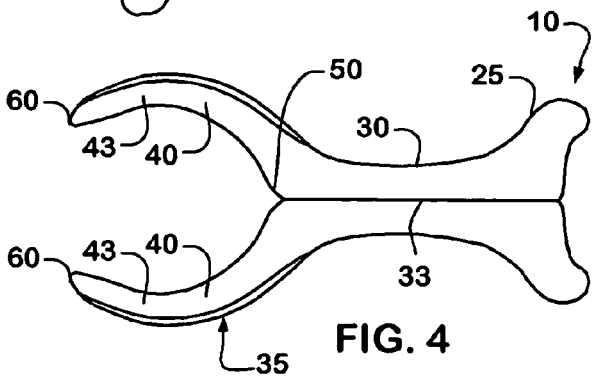
FIG. 4 is a top view of the exemplary embodiment shown in FIG. 2.
Figure 5:
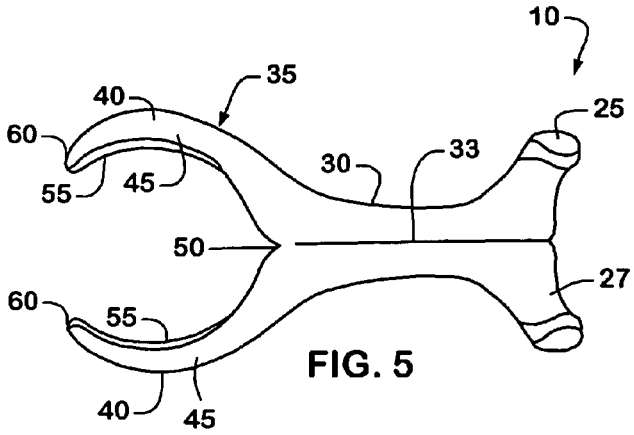
FIG. 5 is a bottom view of the exemplary embodiment shown in FIG. 2.
Figure 6:
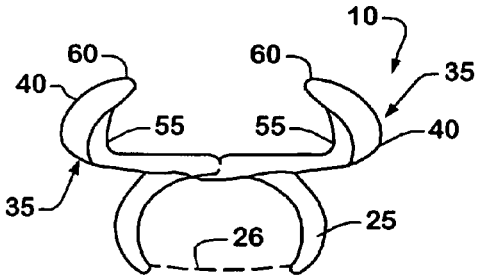
FIG. 6 is a front view of the exemplary embodiment shown in FIG. 2.
Figure 7:
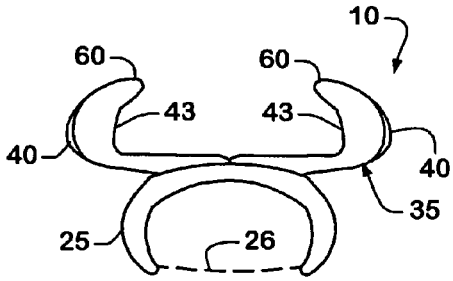
FIG. 7 is a back view of the exemplary embodiment shown in FIG. 2.
Figure 8:
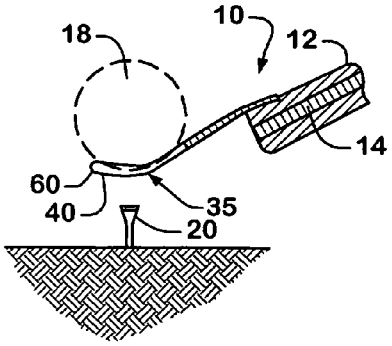
FIG. 8 is a detail section view of the exemplary embodiment shown in FIG. 2 in an exemplary illustrated use.
Figure 9:
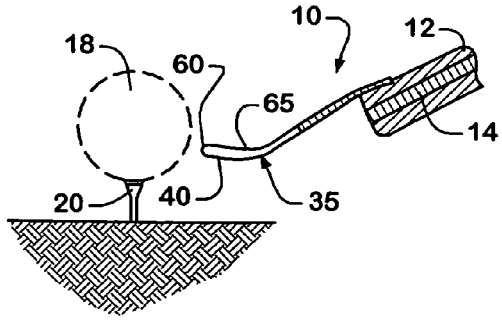
FIG. 9 is a detail section view of the exemplary embodiment shown in FIG. 2 in an exemplary illustrated use.

Referring to FIG. 1, an exemplary embodiment of a golf ball retrieval apparatus 10 is shown attached to a golf club 11. The golf club 11 includes a shaft 14, a handle 12, and a club head 16 with a club face 15.

Referring to FIGS. 1-9, an exemplary embodiment of a golf ball retrieval apparatus 10 according to the present invention is shown. Referring more specifically to FIGS. 2-7, in general, the golf ball retrieval apparatus 10 may include a flexible collar 25, a neck portion 30, a pair of tines 40, a forked carrier 35, and a sloped surface 55 on each of the tines. The golf ball retrieval apparatus 10 may be constructed as a single injection-molded unit where the neck portion 30 bridges the collar 25 to the pair of tines 40 and forked carrier 35.

The pair of tines 40 may project distally away from the neck portion 30 and respectively curve toward one another so as to define a substantially circular and forked carrier 35 between the tines. A sloped surface 55 may be included on the forked carrier 35 aiding the lift or carriage and movement of a golf ball onto the forked carrier. The tines 40 may include respective tine inner surfaces 45, tine outer surfaces 43, and tine ends 60 defining the forked carrier 35 therebetween each of these elements. The sloped surface 55 may be formed on respective tine outer surfaces 43 defining an essentially sixty degree grade 65 from respective tine ends 60 to the neck portion 30. The tine outer surfaces 43 may be curved and twisted slightly inward to face one another.

The flexible collar 25 may be essentially circular to wrap around the handle 12 of the golf club 11. The flexible collar 25 may include collar arms 27 tensioned and formed with a gap 26 between the arms so that the collar 25 may be configured to wrap fittedly around the golf club handle 12. The golf ball retrieval apparatus 10 may be detachably attached to the golf club handle 12 by press fitting the golf club handle through the gap 26 between the collar arms 27. The golf ball retrieval apparatus 10 may then be held in place on the golf club handle 12 by the tension present in the collar arms 27 and removed at will between one golf club and another by slipping the golf ball retrieval apparatus 10 off the golf club handle 12 through the gap 26 or off the golf club handle end 19. While the collar 25 is depicted with an essentially circular body and a gap 26, it will be understood that the collar 25 may be formed to more closely match the shape of a handle as desired and furthermore, that a gap 26 may not be employed in an alternative embodiment where a fully circular collar 25 is used and the collar may be slipped onto the golf club handle via the handle end 19.

The neck portion 30 may be flexible and may bridge the collar 25 to the pair of tines 40 and forked carrier 35. The neck portion 30 may include a slit opening 50 at a point where the forked carrier 35 meets a central line 33 along the neck portion 30.

In one exemplary operation of the golf ball retrieval apparatus 10, referring to FIGS. 1-3 and 8-10, a golfer 22, may attach the golf ball retrieval apparatus 10 to a golf club handle 12 so that the collar 25 wraps partially about the golf club handle 12. When a golf ball 18 is laying on the floor or on a tee 20, the golfer 22 may extend the golf club 11 so that the golf club handle 12 and golf ball retrieval apparatus 10 approach the golf ball 18 from the golfer's standing position. The tine ends 60 may be slipped under the golf ball 18 and the pair of tines 40 slid under the golf ball against the floor or the tee 20. The golf ball 18 may roll back toward the neck portion 30 along the sloped surface 55 and the grade 65 between the curved tine outer surfaces 43 to come to a rest cradled within the forked carrier 35. The golfer may then lift the golf ball 18 held in the forked carrier 35 where the inward curve of the tine outer surfaces 43 may prevent the golf ball 18 from rolling back out of the golf ball retrieval apparatus 10. The slit opening 50 may allow the weight of the golf ball to slightly separate the tines 40 farther from one another allowing the golf ball to sit lower and more securely between the tines. When the golfer 22 wishes to switch clubs, the golf ball retrieval apparatus 10 may be slipped off the current golf club 11 and slipped onto the next club without physical modification to any of the clubs. It will be understood that a golfer 22 may employ the use of the golf ball retrieval apparatus 10 between different club types such as between a driver, a wedge, or a putter.

It may also be appreciated that the golf ball retrieval apparatus 10 may be further employed as a mechanism for aligning a golf swing. Referring to FIGS. 1 and 10-12, another exemplary operation of the golf ball retrieval apparatus 10 is depicted. When the golf ball retrieval apparatus 10 is attached to the handle 12 of a golf club 11, a golfer 22, may use the golf ball retrieval apparatus 10 to adjust the position of a club face 15 on a club head 16. Prior to swinging the golf club 11, the golfer 22 may attach the golf ball retrieval apparatus 10 to the end 19 of the handle 12 so that the pair of tines 40 and tine ends 60 project distally away from the club head 16 along an axis 99 of the golf club 11 running along the shaft 14. The pair of tines 40 may be positioned so that the tine outer surfaces 43 face skyward and are planar to a horizontal defined by the floor. While the golf ball retrieval apparatus 10 is attached in this exemplary position, the club face 15 may be positioned facing orthogonal to the direction the tine ends 60 are pointing along an axis 88. For illustrative purposes, this default position is described in a position that is generally known as the club face 15 being "squared". Thus, as illustrated, when the golf club head 16 is held planar to the floor during a backswing motion, the golf ball retrieval apparatus 10 attached to the handle 12 may be in axial alignment with the golf club head 16. Additionally, the golf ball retrieval apparatus 10 may project distally outward from the handle 12 so that it is within the line of sight of the golfer 12. Should the club face 15 be biased away from the "squared" position, the golfer 22 may make manual adjustments to his or her grip 23 by twisting the golf club handle 18 until the golf ball retrieval apparatus 10 is positioned as desired.

Figure 10:
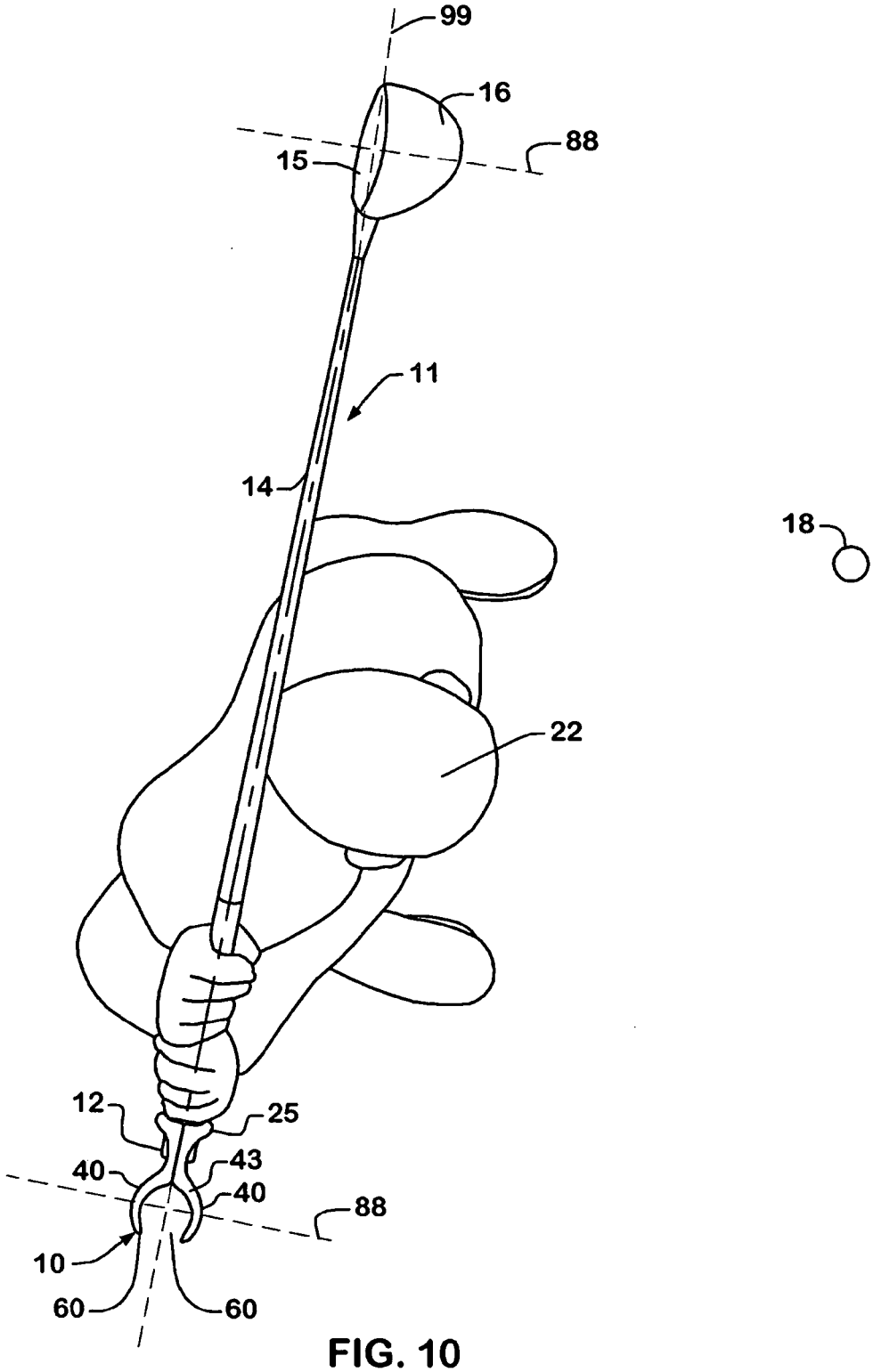
FIG. 10 is a plan view of the exemplary embodiment shown in FIG. 2 in an exemplary illustrated use illustrating club head positioning of a squared face.
Figure 11:
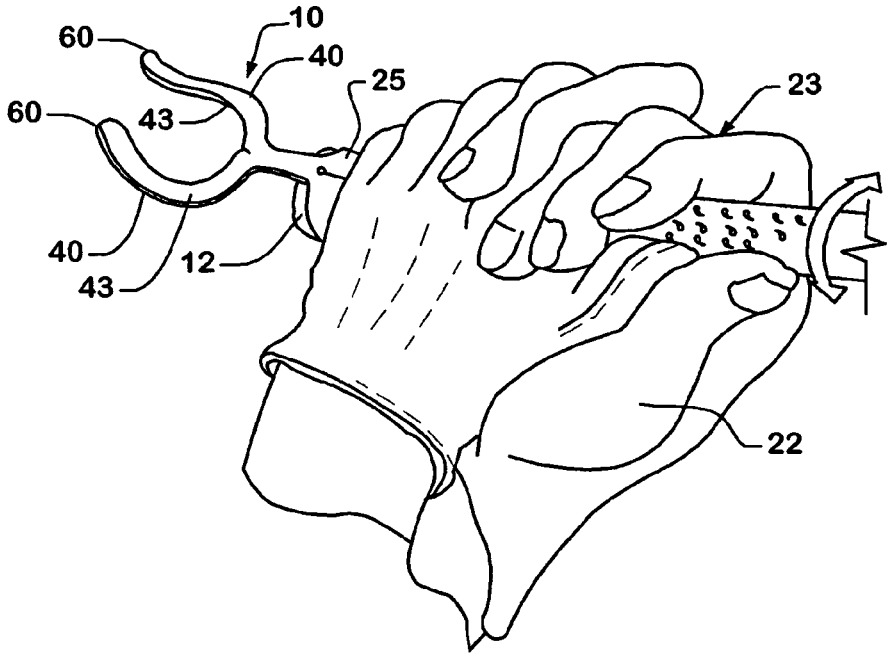
FIG. 11 is a detail perspective view of the exemplary embodiment shown in FIG. 2 in an exemplary illustrated use illustrating club head positioning of a hooked face.
Figure 12:
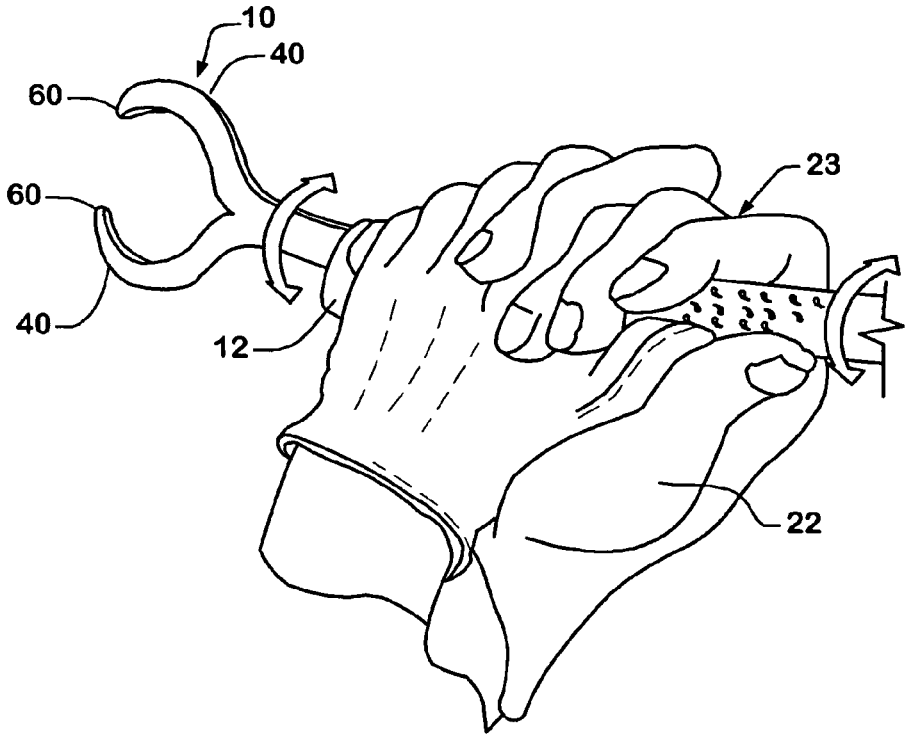
FIG. 12 is a detail perspective view of the exemplary embodiment shown in FIG. 2 in an exemplary illustrated use illustrating club head positioning of a sliced face.

Club face 15 alignment may be further illustrated as break away views (FIGS. 11 and 12) of the golf ball retrieval apparatus 10 attached to the golf club handle 12. The illustrations of the grip 23 in FIGS. 11 and 12 will be understood as being relative to the position of the club head 16 and club face 15 as shown in FIG. 10. FIGS. 11 and 12 illustrate how the grip 23 of the golfer 22 may be positioned initially and then adjusted to align a "hook shot" or a "slice shot". The type of shot may depend on whether the club face 15 is positioned according to the alignment of collar 25 of the golf ball retrieval apparatus 10 to signal that the club face 15 is either in a "hook face", a "slice face", or a "squared face" position during the back swing. Thus, it will be understood that the golf ball retrieval apparatus 10 may be positioned to a default position to produce a "squared face" with the intention of hitting a "squared shot' if the grip 23 is maintained in the correctly aligned position as depicted in FIG. 10 or the grip 23 may be adjusted by rotating the handle 12 and golf ball retrieval apparatus 10 to produce a "hook shot" or a "slice shot" from the default "squared face" position. For illustrative purposes, FIG. 11 depicts adjustment of the golf ball retrieval apparatus 10 rotated from a "squared face" position to "hook face" position for a "hook shot". For illustrative purposes, FIG. 12 depicts adjustment of the golf ball retrieval apparatus 10 rotated from a "squared face" position to "slice face" position for a "slice shot". Also, it will be understood that the golf ball retrieval apparatus 10 may be set in a default position on the handle 12 so that a grip 23 is grasped to produce a "hook shot" or a slice shot" by setting the golf ball retrieval apparatus 10 to signal a "hook face" or a "slice face" alignment. Thus, under this exemplary operation where the golf ball retrieval apparatus 10 is placed on the handle 12 to produce a "hook face" or a slice face" as a default position, it will be understood that the pair of tines 40 may be positioned so that the tine outer surfaces 43 face skyward and are planar to a horizontal defined by the floor but the club face 15 is rotated as desired.

It should be understood, of course, that the foregoing relates to exemplary embodiments of the invention and that modifications may be made without departing from the spirit and scope of the invention as set forth in the following claims.

I claim:

1. A retrieval apparatus for attachment to a golf club handle and retrieval of a golf ball, comprising:

a flexible collar disposed for attachment around the golf club handle;

a neck portion connected to the flexible collar;

a pair of tines projecting distally from the neck portion, wherein the neck portion bridges the collar to the pair of tines and, wherein the tines are disposed to define a substantially circular and forked carrier between the tines; and wherein each tine is twisted and curved inwardly such that an outer surface of each tine faces an outer surface of the other tine of said pair of tines and said outer surfaces are concaved and sloped inwardly to lift the golf ball and guide the golf ball into the forked carrier.

2. The retrieval apparatus of claim 1, wherein the neck portion includes a slit opening where the pair of tines projects from the neck portion.

3. The retrieval apparatus of claim 2, wherein the tines include tine ends and said tines are sloped in a longitudinal direction to define an essentially sixty degree grade at a section of the tines which includes the tine ends.

4. The retrieval apparatus of claim 3, wherein the flexible collar, the neck portion, and the pair of tines are a single injection-molded unit.

5. The retrieval apparatus of claim 4, wherein each of the flexible collar and pair of tines are attached with the neck portion such the flexible collar projects from the neck portion in a substantially opposing direction to that of the pair of tines.

6. The retrieval apparatus of claim 1, wherein the tines include tine ends and said tines are sloped in a longitudinal direction to define an essentially sixty degree grade at a section of the tines which includes the tine ends.

7. The retrieval apparatus of claim 1, wherein the flexible collar, the neck portion, the pair of tines, and the sloped surface are a single injection-molded unit.

8. The retrieval apparatus of claim 1, wherein each of the flexible collar and pair of tines are attached with the neck portion such the flexible collar projects from the neck portion in a substantially opposing direction to that of the pair of tines.

* * * * *